United States Patent [19]

Jankewitz

[11] Patent Number: 4,973,181

[45] Date of Patent: Nov. 27, 1990

[54] COSMETIC APPLICATOR

[75] Inventor: Axel Jankewitz, Fürth, Fed. Rep. of Germany

[73] Assignee: A. W. Faber-Castell GmbH & Co., Stein near Nürnberg, Fed. Rep. of Germany

[21] Appl. No.: 736,564

[22] Filed: May 21, 1985

Related U.S. Application Data

[63] Continuation of Ser. No. 460,884, Jan. 25, 1983, abandoned.

[30] Foreign Application Priority Data

Jan. 26, 1982 [DE] Fed. Rep. of Germany ..... 3202435

[51] Int. Cl.[5] ..... A45D 40/30

[52] U.S. Cl. ..... 401/199; 132/320; 401/198; 401/207

[58] Field of Search ..... 132/88.5, 88.7; 401/198, 199, 206, 207

[56] References Cited

U.S. PATENT DOCUMENTS

| | | | |
|---|---|---|---|
| 3,377,124 | 4/1968 | Matsumoto | 401/206 X |
| 4,452,262 | 6/1984 | Jankewitz | 401/198 |
| 4,496,258 | 1/1985 | Tanaka | 401/198 |

*Primary Examiner*—Steven A. Bratlie

*Attorney, Agent, or Firm*—Michael J. Striker, Jr.

[57] ABSTRACT

Cosmetic applicator for applying a liquid, particularly a solving medium to the human skin for removing a make-up or rouge from the skin. The applicator includes a container with a tampon impregnated with a solving medium therein and an applicator tip which can be easily replaced with a new one after the used tip has become contaminated.

1 Claim, 1 Drawing Sheet

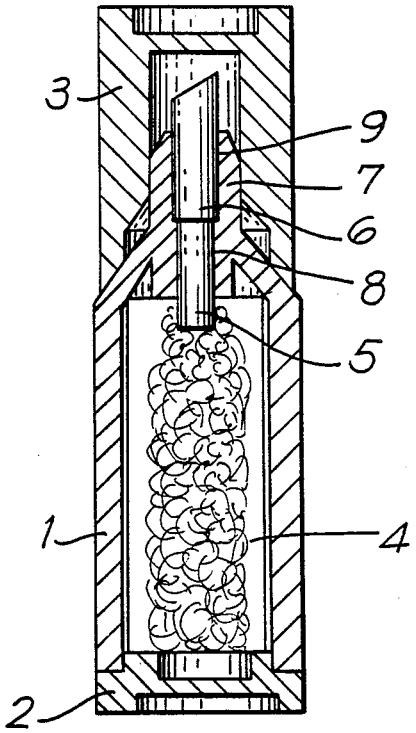
3
9
7
6
8
5
1
4
2

COSMETIC APPLICATOR

This is a continuation of application Ser. No. 460,884 filed Jan. 25, 1983 now abandoned.

BACKGROUND OF THE INVENTION

The present invention relates to cosmetic devices in general, and more particularly to a cosmetic applicator.

Known cosmetic applicators of the type under discussion include a storage container in which a solving medium is contained. A tampon impregnated with a solving medium or a suitable cosmetic substance may be accommodated in the container. An applicator tip is connected to the solving medium in the container to suck out the medium therefrom. The container is normally closed with a lid which is removed therefrom before application of the solving medium onto a skin.

It has been known that painting cosmetic substances or so-called make-up are widely used in practice, which substances have been removed from the human skin by special solving media or liquid substances in order to remove spots from the skin and cleanse the same.

When a solving medium has been applied to the human skin by means of known cosmetic applicators customary wick pencils have been used, in which the wick has absorbed the make-up and removed it from the skin. Of course, it is understood that eventually the capillary applicator tip of the cosmetic applicator becomes contaminated. In this case the make-up or rouge collected on the tip must from time to time be removed from the applicator tip; various suction pads of soft foam material, or fleece material applied to a cellulose or staple fiber or cotton base have been used for cleaning the tip.

SUMMARY OF THE INVENTION

It is an object of this invention to provide an improved cosmetic applicator, particularly for removing an excessive make-up from the human skin.

It is a further object of the invention to provide a cosmetic applicator for applying a solving medium and simultaneously removing make-up or rouge from the skin, which applicator does not, however require special elements for cleaning the applicator tip.

These and other objects of the invention are attained by a cosmetic applicator, comprising a storage container containing a tampon impregnated with a solving medium; a capillary applicator tip extended outwardly from the container and connected thereto to receive the solving medium therefrom, a lid sealingly closing said container and said tip and detachable therefrom for use, said container including a supporting portion in which said applicator tip is held, said tip being replaceable and having a blunt rear end; and a feeding system interconnected between said tampon and said rear end of said tip, said feeding system being in constant contact with said tampon.

With the applicator of the invention it is possible that the excessive rouge or make-up can be picked up by the applicator tip from the edges of the sharp lines of the cosmetic substance on the skin and from the relatively large surfaces as well. The applicator tip can be easily removed from the supporting portion of the container and replaced with a new fresh tip.

The applicator tip may be made out of a fiber wick produced by radial cutting of the wick. Furthermore, the feeding system can be also made from a radially cut fiber wick. These both parts therefore can be produced from the same material.

In accordance with a further feature of the invention the supporting portion of the container may have a first bore for the feeding system received in said first bore and a second bore merging into said first bore and having a larger diameter than said first bore, said applicator tip being received in said second bore.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates a sectional axial view through a cosmetic applicator according to the invention.

DETAILED DESCRIPTION OF THE PREFERRED EMBODIMENT

Referring now to the drawing, it is seen that a make-up or cosmetic applicator according to the invention includes a container 1 of a substantially cylindrical shape, at the rear blunt end of which a cover 2 is mounted, which closes the container. The front end of the container is closed with a detachable lid 3 which sealingly closes container 1 when fit thereon.

A tampon 4 impregnated with a solving medium is inserted in container 1. The end portion of the tampon is connected to a feeding system 5 which is partially extended into the tampon.

Container 1 at the front end thereof is formed with a support or holding portion 7 provided with a guide bore 9 receiving a capillary applicator tip 6 which is made of a fiber wick. Guide bore 9 of a greater diameter merges into a receiving bore 8 of a smaller diameter extended up to the end of tampon 4.

The feeding system 5 which is made of a fiber wick is disposed in bore 8. The applicator tip 6 and the aforementioned feeding system 5 are held in the support portion 7. The front end of the tip 6 projects outwardly from bore 9. Alternatively, the guide bore 9 may extend over the whole length of the applicator tip. In any case it is ensured that the applicator tip can be easily pulled out from the support portion 7 of container 1 so that it can be replaced with a new clean applicator tip. The length of the guide bore 9 is so selected that the applicator tip 6 has a sufficient support in the container.

The cosmetic applicator according to the invention has the following advantages:

1. The contact with the tampon which serves as a supply of a solving medium is always maintained during the replacement of the applicator tip.
2. Owing to a relatively small length of the applicator tip the time period of the suction of the liquid, or solving medium out from the container is relatively short.
3. Only a very small quantity of solving medium is lost during the replacement of the contaminated applicator tip with a new one because the tip itself does not extend into the tampon.
4. The applicator tip is easy to replace because it is inserted into the guide bore of a relatively small length.
5. The support of the applicator tip on the feeding system is reliable and is suitable for receiving higher pressures than those applied immediately onto the relatively soft tampon in known arrangements.

6. The production of such replaceable short applicator tips is less expensive than those which are extended to and applied immediately to the tampon.

It will be understood that each of the elements described above, or two or more together, may also find a useful application in other types of cosmetic applicators differing from the types described above.

While the invention has been illustrated and describe as embodied in a cosmetic applicator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cosmetic device for cleaning the human skin, comprising a storage container having an axis, said storage container having a supporting portion which is of one piece with a remaining portion of said storage container and has a first axial bore of a smaller diameter and a second axial bore of a larger diameter so as to form a shoulder between said axial bores;

a tampon impregnated with a solving medium and received in said container;

a one-piece capillary applicator tip for applying a solving medium, said tip being received in said second axial bore of a larger diameter in said supporting portion of said container and having axially spaced front and rear ends, said applicator tip extending axially forwardly with said front end beyond said storage container and being subjected to application pressure applied to said applicator tip during applying a solving medium;

a lid sealingly closing said container and said tip and removable therefrom for use; and a feeding system formed by a member which is separate from said tip and located in said first axial bore of a smaller diameter in said supporting portion of said container between said tampon and said tip to supply the solving medium from said tampon to said tip, said rear end of said tip being in surface contact with said member of said feeding system over a radial surface and said tip being readily withdrawable from said second axial bore of said supporting portion of said container in an axial forward direction away from said tampon and said member of said feeding system, said rear end of said tip in addition to being in surface contact with said member of said feeding system also abutting against said shoulder of said storage container so that said shoulder performs the function of supporting said tip and taking up the application pressure applied to said applicator tip, while said member of said feeding system substantially does not perform the function of supporting said tip and taking up the application pressure applied to said applicator tip, and therefore can be formed of a soft material.

* * * * *